US006467132B1

(12) United States Patent
Robley

(10) Patent No.: US 6,467,132 B1
(45) Date of Patent: Oct. 22, 2002

(54) BAND FOR SECURING ITEMS AND METHOD OF USE

(76) Inventor: Spencer Hart Robley, Apt. B422, 13603 Marina Pointe Dr., Marina del Rey, CA (US) 90290

( * ) Notice: Subject to any disclaimer, the term of this patent is extended or adjusted under 35 U.S.C. 154(b) by 0 days.

(21) Appl. No.: 09/841,779

(22) Filed: Apr. 24, 2001

(51) Int. Cl.[7] ..... B65D 63/00
(52) U.S. Cl. ..... 24/16 PB; 24/20 TT; 24/20 R
(58) Field of Search ..... 24/16 PB, 20 TT, 24/23 CW, 20 R, 20 CW; 248/74.3

(56) References Cited

U.S. PATENT DOCUMENTS 2,935,773 A * 5/1960 Weckesser ..... 24/16 PB
3,293,709 A * 12/1966 Holton ..... 24/20 TT
3,620,896 A * 11/1971 Glasgow ..... 428/167
3,653,099 A * 4/1972 Hoffman ..... 24/16 PB
3,694,863 A * 10/1972 Wasserlein, Jr. ..... 24/16 PB
4,447,934 A * 5/1984 Anscher ..... 24/16 PB
4,615,185 A * 10/1986 Bollinger ..... 63/1.13
4,631,782 A * 12/1986 Gecs ..... 24/16 PB
5,722,123 A * 3/1998 Davignon et al. ..... 24/16 PB
6,038,743 A * 3/2000 Chapman ..... 24/3.2
6,349,904 B1 * 2/2002 Polad ..... 248/74.3

* cited by examiner

*Primary Examiner*—Robert J. Sandy
(74) *Attorney, Agent, or Firm*—Timothy Thut Tyson; Ted Masters; Freilich, Hornbaker & Rosen

(57) ABSTRACT

The present invention comprises a band 20 which is used to secure single or multiple items. Band 20 has a first set of teeth 30 disposed on a first side 26 at a first end 22, and a second set of teeth 32 disposed on a second side 28 at an opposite second end 24. An aperture 34 is located near second end 24. Band 20 is wrapped around the item or items. First end 22 is then inserted into aperture 34 and band 20 is closed so that first teeth 30 interlockingly engage second teeth 32, thereby preventing band 20 from opening.

3 Claims, 7 Drawing Sheets

BAND FOR SECURING ITEMS AND METHOD OF USE

TECHNICAL FIELD

The present invention is directed to holders for securing items, and more particularly to a flexible band which may be wrapped around one or more items. The band has cooperating interlocking teeth which engage in ratchet-type fashion to hold the band around the item or items.

BACKGROUND ART

In the field of retaining articles for ease of handling, as for example a bundle of wood, or in the building or construction trade, as for example for supporting wires, conduits, pipes, and the like on a structure, it is desirable to have a device which can conveniently be used to hold or secure the articles. Particularly in the automotive, aviation, and telecommunications industries it is desirable to have bands or holders which may be easily put in place to rigidly retain electrical wiring, fiber optics, or conduits together and in place.

One of the most common bands is made of plastic having teeth on one side and a retainer on the same side. Inside the retainer is a complementary tooth or teeth. When the end of the band is inserted into the retainer, the teeth engage keeping the band from pulling out of the retainer. A low cost band or holder nor requiring a separate molded retainer would offer advantages in many applications.

DISCLOSURE OF INVENTION

The present invention is directed to a band or holder which is made of flexible or conformable material such as plastic and is easily put in interlocking relationship about single or multiple objects keeping them in a bundle. The band also may include a connector which can be used to attach the band and its encircled contents to a support member. The connector embodiment is useful for attaching pipes, wires, fiber optics, conduits and such materials to a support member such as a pipe, beam, or surface. In a preferred embodiment of the invention, the band is made of thin-walled, flexible, construction keeping the cost relatively low.

In accordance with a preferred embodiment of the invention, a band for securing items includes a first end, an opposite second end, a first side, and an opposite second side. A plurality of first teeth are disposed on the first side near the first end, and a plurality of second teeth are disposed on the second side near the second end. An aperture, shaped and dimensioned to accept the first end, is located near the second end so that the second teeth are positioned between the aperture and the first end. When the band is closed by inserting the first end through the aperture, the first and second teeth engage in cooperative interlocking relationship so that the band cannot be again opened.

In accordance with an important aspect of the invention, the band has a connector for attaching the band to a support member such as a pipe, beam, or surface. The connector is disposed on the first side of the band so that when the band is wrapped around an item the connector projects outwardly from the band.

In accordance with an important feature of the invention, the connector can be (1) a hook-shaped member, (2) a member having a bulbous end, (3) an elongated tab, (4) adhesive, or (5) one of hook and loop fasteners.

In accordance with another important feature of the invention, a plurality of spaced holes are located along each end of the band. A pliers can then be used to tighten the band by inserting cylindrical or hooked jaws into the holes and squeezing the pliers to tighten the band around the object or objects being secured. Repeated application of the pliers tightens the band to the desire compression.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
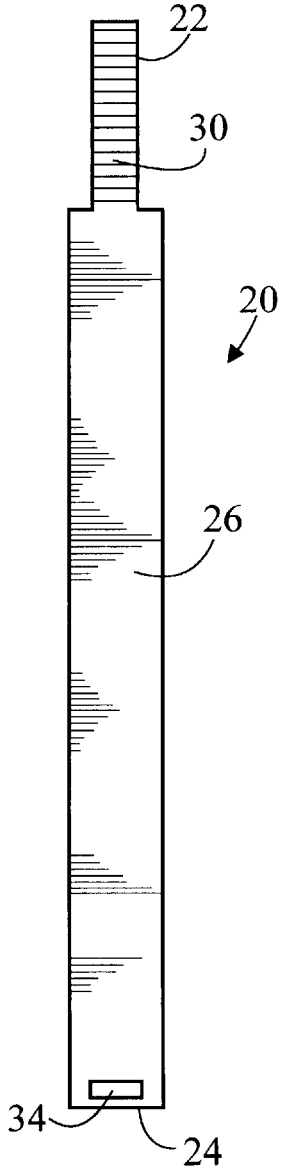
FIG. 1 is a top plan view of a band for securing items in accordance with the present invention.
Figure 2:
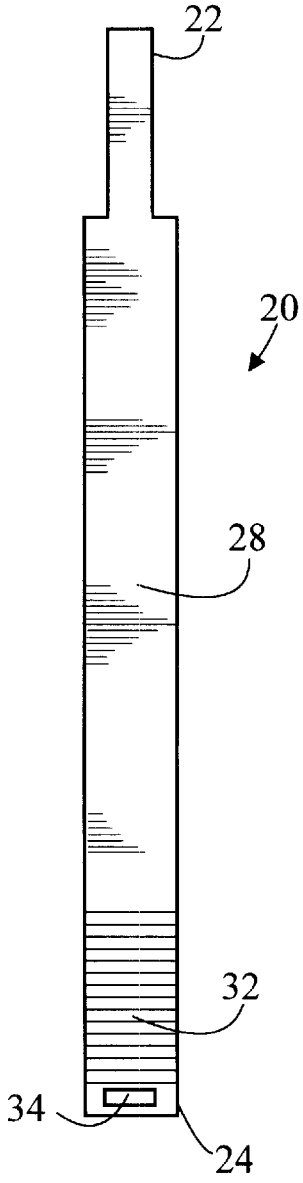
FIG. 2 is a bottom plan view of the band.
Figure 3:
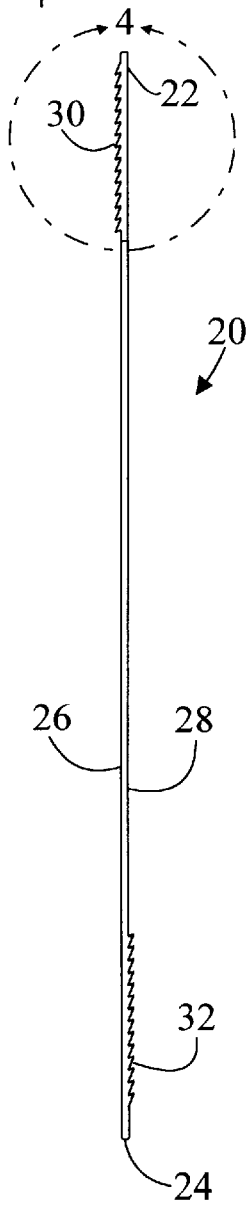
FIG. 3 is a side elevation view of the band.

Referring initially to FIGS. 1–3, there are illustrated top plan, bottom plan, and side elevation view, respectively, of a band in accordance with the present invention, generally designated as 20. Band 20 has a thin flexible body and includes a first end 22, an opposite second end 24, a first side 26, and an opposite second side 28. A plurality of first teeth 30 are longitudinally disposed on first side 26 near first end 22. A plurality of second teeth 32 are longitudinally disposed on second side 28 near second end 24. In the shown embodiment, teeth 30 and 32 have a saw tooth shape causing first teeth 30 and second teeth 32 to interlock when band 20 is closed around an object. It may be appreciated, however, that the teeth 30 and 32 could be of different shapes, such as square, so long as teeth 30 and 32 can be placed in interlocking relationship.

An aperture 34 is located near second end 24 positioning second teeth 32 between aperture 34 and first end 22. Aperture 34 is shaped and dimensioned to accept first end 22. When first end 22 is inserted through aperture 34, first teeth 30 and second teeth 32 engage in cooperative interlocking relationship (also refer to FIGS. 6 and 7).

Figure 4:
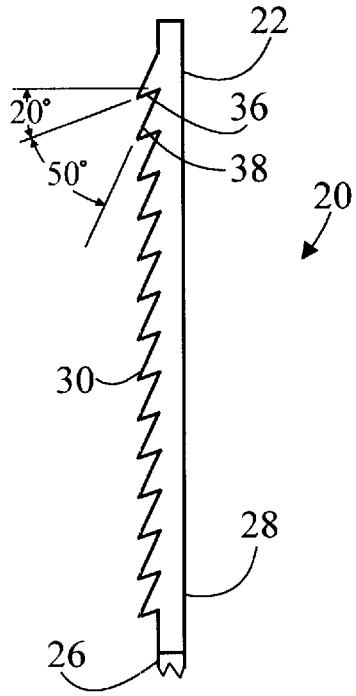
FIG. 4 is an enlarged view of area 4 of FIG. 3.

FIG. 4 is an enlarged view of area 4 of FIG. 3 showing first teeth 30 disposed on first side 26 of band 20. In the shown preferred embodiment, teeth 30 are saw tooth shaped and have walls 36 and 38 which are separated by about 50° with walls 36 angled 20° from a line perpendicular to the opposite second side 28.

Figure 5:
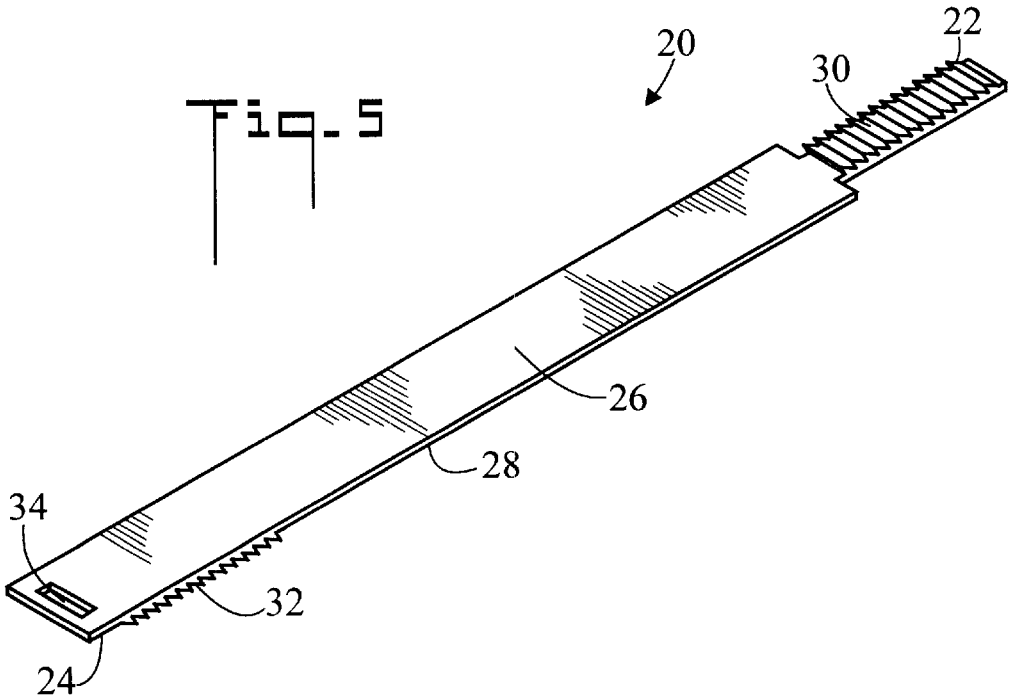
FIG. 5 is a perspective view of the band.

FIG. 5 is a perspective view of band 20.

Figure 6:
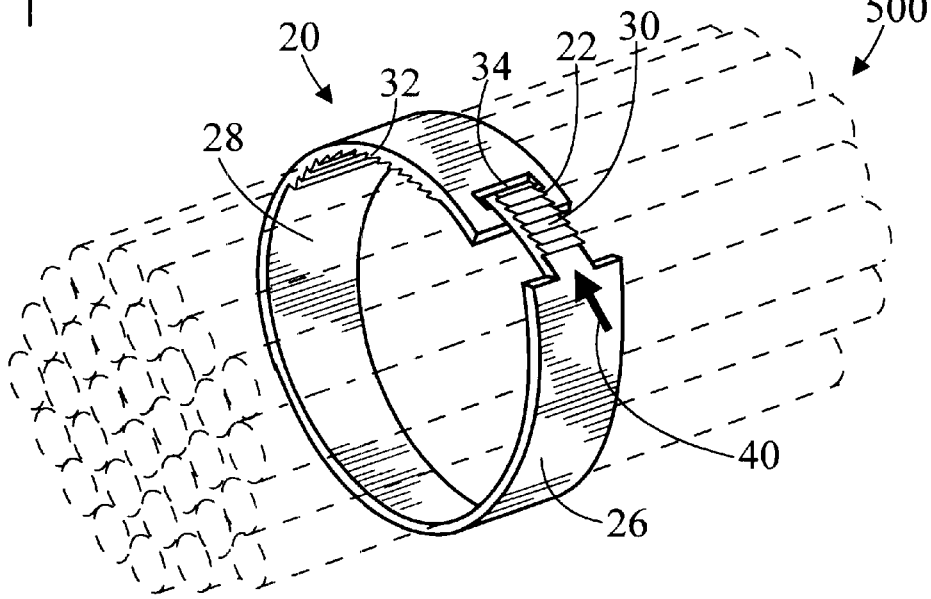
FIG. 6 is a perspective view of the band being placed around a bundle of items.

FIG. 6 is a perspective view of band 20 being placed around a bundle of items 500. First end 22 is inserted through aperture 34 and pushed in direction 40. First teeth 30 lockingly engage second teeth 32 in unidirectional ratchet-type fashion, so that once first end 22 is inserted it cannot be pulled out of aperture 34.

Figure 7:
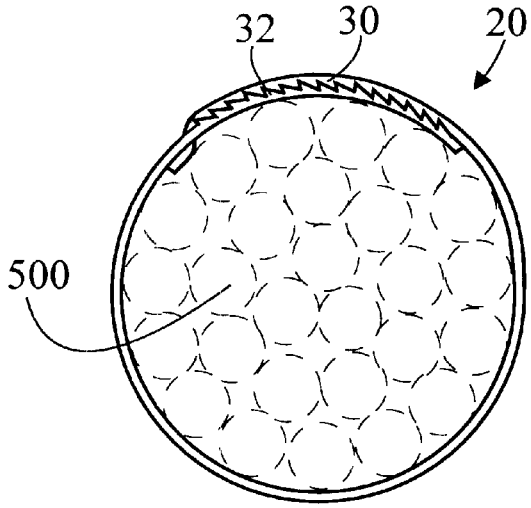
FIG. 7 is an end view of the band encircling the bundle of items.

FIG. 7 is an end view of band 20 encircling bundle of items 500. First teeth 30 and second teeth 32 are interlocked so that band 20 cannot open.

Figure 8:
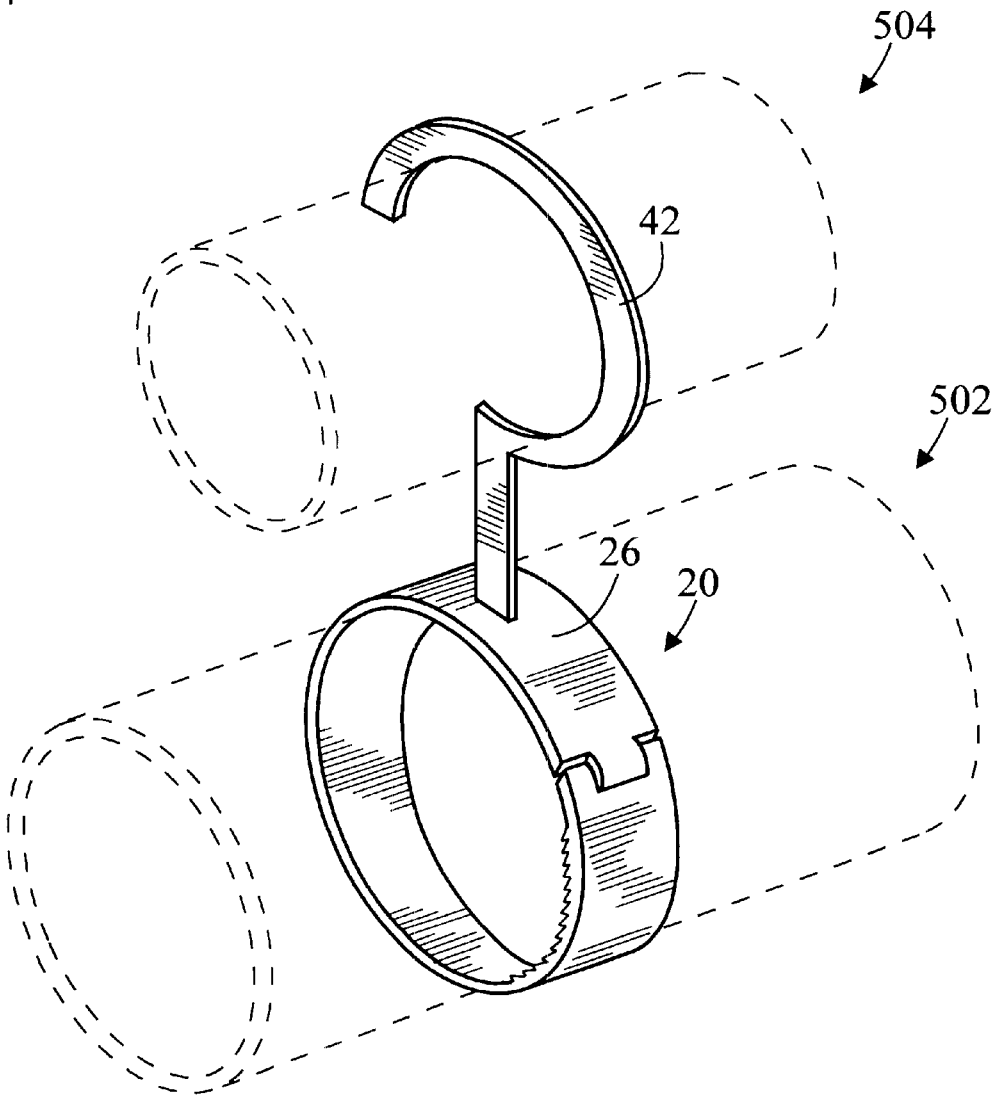
FIG. 8 is a perspective view of the band and encircled pipe being attached to a support member.

FIG. 8 is a perspective view of band 20 and encircled pipe 502 being attached to a support member 504. Band 20 has a connector for attaching band 20 to support member 504. In this embodiment the connector is a hook-shaped member 42 which can be placed over support member 504 which is a pipe. Hook-shaped member 42 can either be integrally formed with band 20, or alternatively can be separate and captively inserted through a slot or hole in band 20. It is important to note that the connector must be disposed on first side 26 so that when band 20 is wrapped around an item the connector will be on the outside.

Figure 9:
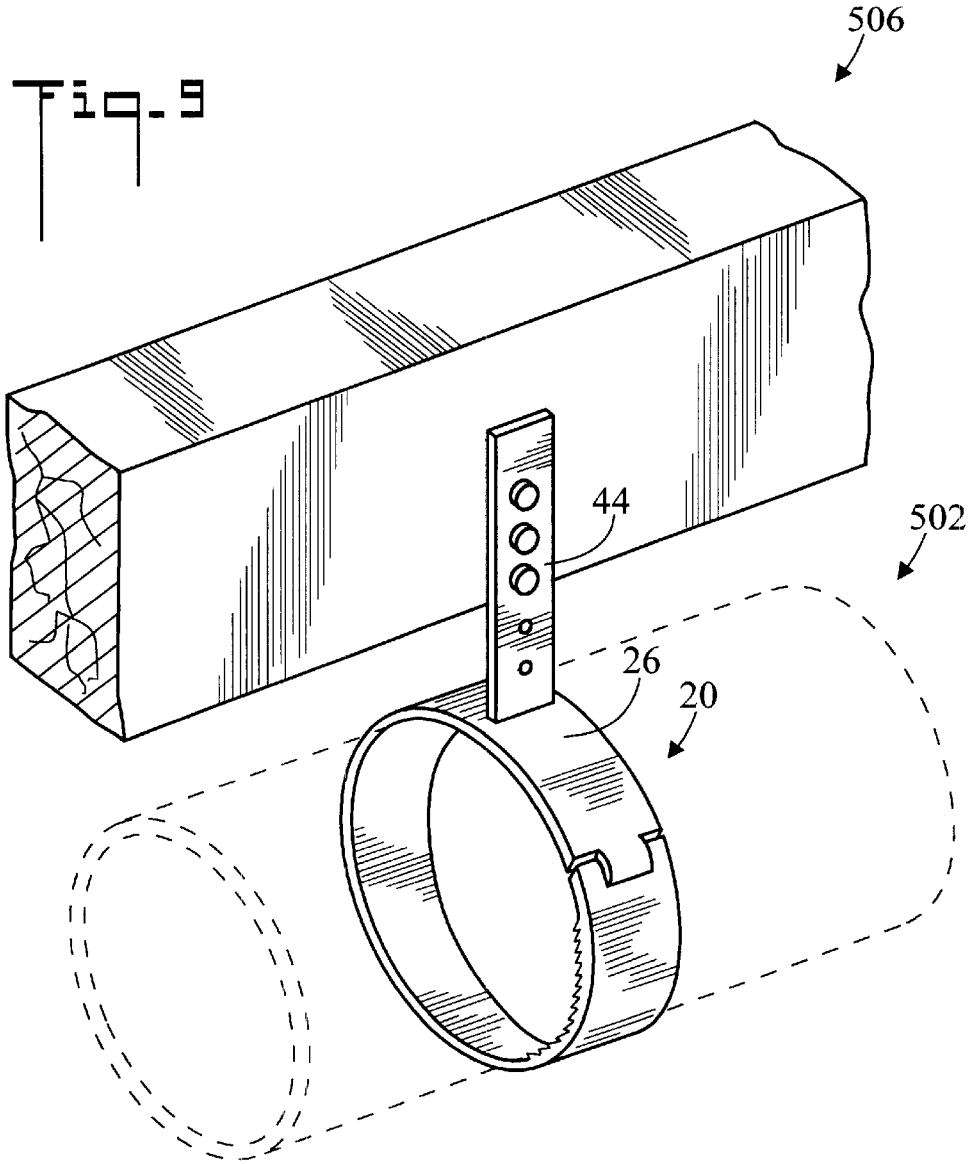
FIG. 9 is a perspective view of the band and encircled pipe being attached to a second support member.

FIG. 9 is a perspective view of band 20 and encircled pipe 502 being attached to a second support member 506. In this embodiment, the connector is an elongated tab 44 which is nailed into second support member 506, a wood beam.

Figure 10:
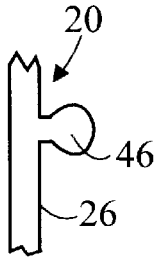
FIG. 10 is an enlarged fragmented view of a connector having a bulbous end.

FIG. 10 is an enlarged fragmented view of a connector having a bulbous end 46 which is attached to band 20. Bulbous end 46 can be pressure fit into a female receptacle on a support member or surface.

Figure 11:
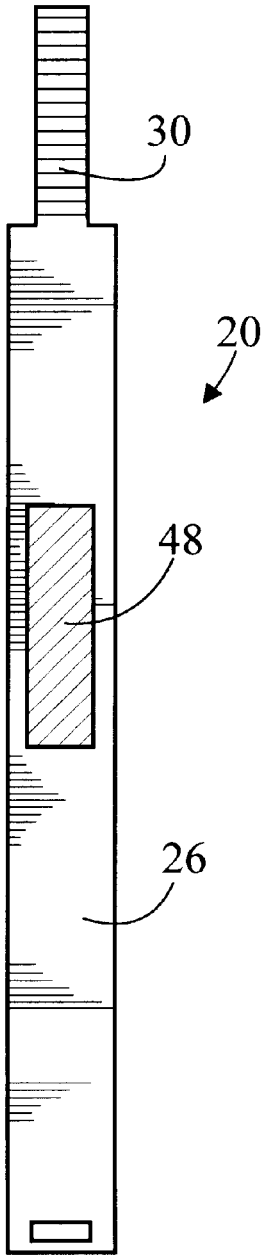
FIG. 11 is a top plan view of the band and an adhesive connector.

FIG. 11 is a top plan view of band 20 and an adhesive connector 48. Adhesive connector 48 may be used to attach band 20 and its encircled contents to a support member such as a surface. Alternatively, hook and loop fasteners can be employed to perform the same purpose, wherein one of the hook and loop fasteners is disposed on first side 26 of band 20, and the other of hook and loop fasteners is disposed on the support member.

Figure 12:
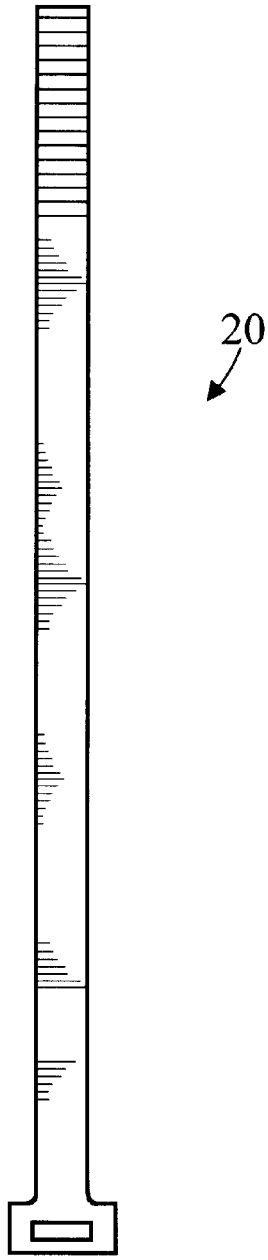
FIG. 12 is a top plan view of an alternatively shaped band.

FIG. 12 is a top plan view of an alternatively shaped band 20. In this embodiment band 20 has a thinner "belt" shape. It may be appreciated that band 20 could be made in various widths and lengths to accommodate different size items.

Figure 13:
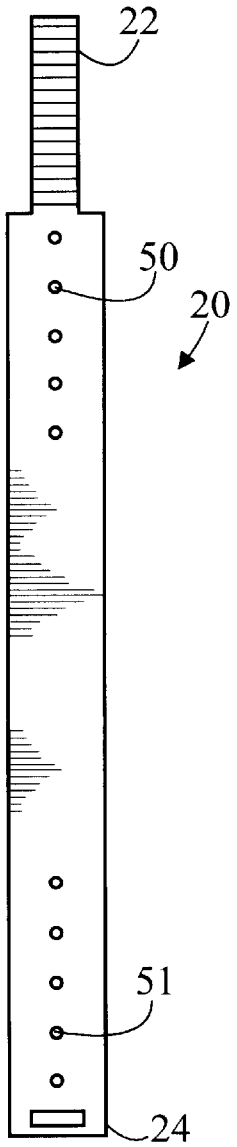
FIG. 13 is a top plan view of a band having a plurality of spaced holes; and, FIG. 14 is a perspective view showing how the spaced holes are utilized to tighten the band.
Figure 14:
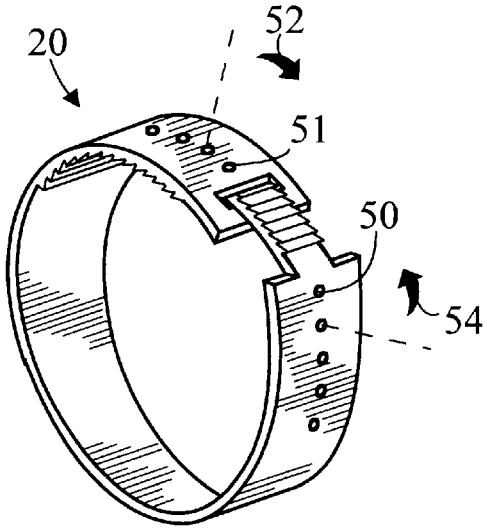

FIGS. 13 and 14 are top plan and perspective views, respectively, of a band 20 having a plurality of spaced holes. A first plurality of spaced holes 50 are located near first end 22 and a second plurality of spaced holes 51 are located near second end 24. Holes 50 and 51 accommodate special pliers with cylindrical and/or hooked jaw ends such as found on snap ring pliers which can be used to draw together band 20 in directions 52 and 54. The pliers are first positioned in one set of holes and squeezed together ratcheting teeth 30 and 32 along each other to tighten the band 20 around an object or objects. The pliers are then moved to another set of convenient holes where the process is repeated. The process is repeated until the desired compression is reached.

In terms of construction, band 20 is preferably made from a polymer such as polyethylene or polypropylene using conventional molding or extrusion techniques. If a molding technique is used, each band is made in a separate cavity. If an extrusion method is used, a ribbon having the desired profile is extruded which is punched and cut to achieve the end product. It may be appreciated, however, that other materials and methods could also be employed.

In terms of use, a method for securing items comprises providing band 20 having first teeth 30, second teeth 32, and an aperture 34; providing at least one item; wrapping the band around the item; and, inserting the first end 22 through the aperture 34 so that first teeth 30 and second teeth 32 engage in interlocking relationship. Additionally, if band 20 has a connector for attaching band 20 to a support member, using the connector to attach the band 20 to the support member.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A band, comprising:

a first end and an opposite second end;

a first side and an opposite second side;

a plurality of first teeth disposed on said first side near said first end;

a plurality of second teeth disposed on said second side near said second end;

an aperture shaped and dimensioned to accept said first end, said aperture located near said second end so that said second teeth are disposed between said aperture and said first end;

so that when said first end is inserted through said aperture, said first teeth and said second teeth engage in cooperative interlocking relationship; and, except for said first and second teeth, said band having an absolutely flat surface above which no connective device protrudes.

2. A method for securing items, comprising:

(a) providing a band having a first end and an opposite second end, a first side and an opposite second side, a plurality of first teeth disposed on said first side near said first end, a plurality of second teeth disposed on said second side near said second end, an aperture shaped and dimensioned to accept said first end, said aperture located near said second end so that said second teeth are disposed between said aperture and said first end;

(b) providing at least one item;

(c) wrapping said band around said item; and, (d) inserting said first end through said aperture so that said first teeth and said second teeth engage in interlocking relationship;

(e) said step (b) further including providing a first plurality of spaced holes located near said first end and a second plurality of spaced holes located near said second end, so that in step (d) when said first teeth engage said second teeth, said first plurality of spaced holes reside on an opposite side of said aperture from said second plurality of spaced holes;

(f) providing a pliers with jaws for inserting in select holes of said first and second plurality of holes;

(g) inserting said jaws into said select holes of said first and second plurality of holes so that one jaw resides on one side of said aperture and another jaw resides on an opposite side of said aperture; and, (h) squeezing said pliers to ratchet said first and second teeth along each other to tighten said band about said at least one item.

3. A band, comprising:

a first end and an opposite second end;

a first side and an opposite second side;

a plurality of first teeth disposed on said first side near said first end;

a plurality of second teeth disposed on said second side near said second end;

an aperture shaped and dimensioned to accept said first end, said aperture located near said second end so that said second teeth are disposed between said aperture and said first end;

so that when said first end is inserted through said aperture, said first teeth and said second teeth engage in cooperative interlocking relationship;

each tooth of said first and second teeth formed by a first wall and a second wall, wherein:

said first wall is inclined about 20° from a line which is perpendicular to a longitudinal centerline of said band; and, said second wall is inclined about 70° from said line which is perpendicular to said longitudinal centerline of said band.

* * * * *